US012560079B2

(12) United States Patent
Frank Grande, III

(10) Patent No.: US 12,560,079 B2
(45) Date of Patent: Feb. 24, 2026

(54) ELECTRIC SUBMERSIBLE PUMP DOWNHOLE MONITORING AND DIAGNOSTICS SYSTEM AND METHOD

(71) Applicant: MAGNEY GRANDE DISTRIBUTION, INC., Bayfield, CO (US)

(72) Inventor: Salvatore Frank Grande, III, Bayfield, CO (US)

(73) Assignee: MAGNEY GRANDE DISTRIBUTION, INC., Bayfield, CO (US)

( * ) Notice: Subject to any disclaimer, the term of this patent is extended or adjusted under 35 U.S.C. 154(b) by 0 days.

(21) Appl. No.: 18/910,044

(22) Filed: Oct. 9, 2024

(65) Prior Publication Data

US 2025/0129707 A1 Apr. 24, 2025

Related U.S. Application Data

(60) Provisional application No. 63/545,489, filed on Oct. 24, 2023.

(51) Int. Cl.

| | |
|---|---|
| ***E21B 47/008*** | (2012.01) |
| ***E21B 17/00*** | (2006.01) |
| ***E21B 43/12*** | (2006.01) |
| ***E21B 47/135*** | (2012.01) |

(52) U.S. Cl.

CPC ..... *E21B 47/008* (2020.05); *E21B 17/003* (2013.01); *E21B 43/128* (2013.01); *E21B 47/135* (2020.05)

(58) Field of Classification Search

CPC .... E21B 47/008; E21B 17/003; E21B 43/128; E21B 47/135

See application file for complete search history.

(56) References Cited

U.S. PATENT DOCUMENTS

| | | | | |
|---|---|---|---|---|
| 6,167,965 | B1 | 1/2001 | Bearden | |
| 10,385,857 | B2 | 8/2019 | Nguyen | |
| 10,571,590 | B2 | 2/2020 | Noui-Mehidi | |
| 10,876,393 | B2 | 12/2020 | Rendusara | |
| 11,078,774 | B2 | 8/2021 | Gupta | |
| 11,208,876 | B2 | 12/2021 | Eslinger | |
| 11,365,613 | B2 | 6/2022 | Romer | |
| 2002/0162240 | A1 * | 11/2002 | Lechen | E21B 47/08 33/544 |

(Continued)

OTHER PUBLICATIONS

Phoenix xt150 standard ESP monitoring system; https://www.sib.com/completions/artificial-lift/electrical-submersible-pumps/gauges/phoenix-xt150-downhole-monitoring system.

*Primary Examiner* — Brad Harcourt

(74) *Attorney, Agent, or Firm* — G. Michael Roebuck, P.C.; G. Michael Roebuck

(57) ABSTRACT

A fiber optic sensing system is disclosed for improved accuracy analysis of an ESP operating downhole. The fiber optic system continues to operate and transmit data after a down hole power cable has been grounded and cannot transmit data over the downhole power cable. Analysis of harmonics and power quality up to the two hundredth harmonic are measured and analyzed. Transient peaks along the complete cable run are measured and analyzed along with measures of electrical frequency; and 3 Phase Voltage & Current at the motor.

18 Claims, 13 Drawing Sheets

(56) References Cited

U.S. PATENT DOCUMENTS

| | | | | |
|---|---|---|---|---|
| 2003/0192692 | A1* | 10/2003 | Tubel | E21B 47/18 340/854.6 |
| 2016/0084069 | A1* | 3/2016 | Camacho Cardenas | F04D 29/445 415/118 |
| 2017/0089192 | A1 | 3/2017 | Rendusara et al. | |
| 2017/0184657 | A1* | 6/2017 | Neti | E21B 17/003 |
| 2018/0051700 | A1 | 2/2018 | Sheth et al. | |
| 2018/0163524 | A1 | 6/2018 | Batarseh | |
| 2018/0209252 | A1* | 7/2018 | Shanks | E21B 43/128 |
| 2021/0372269 | A1 | 12/2021 | Gooneratne et al. | |
| 2021/0381350 | A1 | 12/2021 | Semple et al. | |
| 2023/0110823 | A1 | 4/2023 | Grande, III et al. | |
| 2024/0117719 | A1* | 4/2024 | Gambaretto | E21B 43/128 |
| 2024/0318540 | A1* | 9/2024 | Hondred | E21B 47/008 |
| 2025/0067164 | A1* | 2/2025 | Gupta | E21B 44/00 |
| 2025/0122794 | A1* | 4/2025 | Rao | E21B 43/128 |

* cited by examiner

ELECTRIC SUBMERSIBLE PUMP DOWNHOLE MONITORING AND DIAGNOSTICS SYSTEM AND METHOD

CROSS REFERENCE TO RELATED APPLICATIONS

This patent application claims priority to U.S. provisional patent application Ser. No. 63/545,489 filed by Grande, et al. on Oct. 24, 2023, entitled "An Electric Submersible Pump Downhole Monitoring And Diagnostics," all which is hereby incorporated herein by reference in their entireties.

BACKGROUND OF THE INVENTION

Electric submersible pumps (ESPs) are widely used to increase the flow of fluids from production oil wells when an oil reservoir has depleted energy to naturally produce at economic rates or to boost early production to improve financial performance for a producing well. It is important to monitor the performance of the ESP to determine when problems arise downhole in the ESP and connecting cables running from the surface of the Earth to the downhole ESP. Down time due to ESP failures is expensive and desired to be avoided.

FIELD OF THE INVENTION

The present invention relates to the field of ESPs and in particular the use of downhole sensors and fiber optic cable in diagnostic operations to diagnose problems in a downhole ESP to extend the run life of the ESP.

Figure 1:
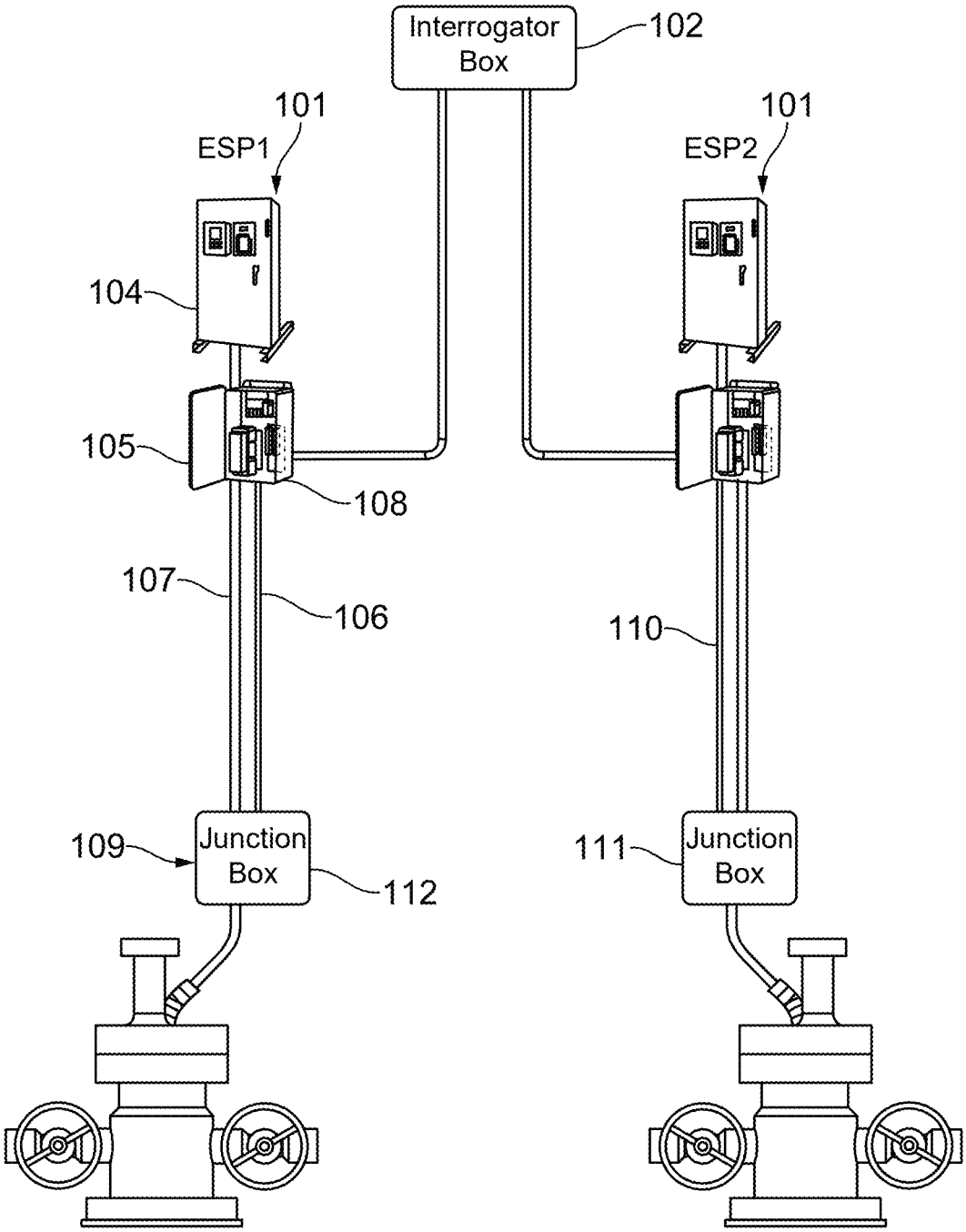
FIG. 1, as shown in FIG. 1, in a particular illustrative embodiment of the invention, a Surface Interrogator, Software, Transducers, Data from vent box to Interrogator, Secondary source-oscilloscope, Modbus protocol, Tiered Offering/Phases, and Back to back pads/8 ESPs per pad.

The drawings presented herein are for illustrative purposes only and do not limit the scope of the claims. Rather, the drawings are intended to help enable one having ordinary skill in the art to make and use the claimed inventions. The drawings are drawn to scale.

SUMMARY OF THE INVENTION

An ESP monitoring system using a downhole sensor package attached to an ESP and fiber optic cable is disclosed. The ESP monitoring system provides improved accuracy analysis of voltage, voltage frequency and current supplied at an ESP operating downhole. The ESP sensing system continues to operate and transmit data even after a down hole power cable has been grounded and cannot transmit data over the downhole power cable. Analysis of voltage, frequency, current, electric distortion and harmonics and derivation of power quality up to and exceeding the one hundredth harmonic are measured and analyzed. Transient voltage peaks along the complete power supply cable length run to the ESP are measured and analyzed along with measures of electrical frequency to diagnosis and predict problems in the ESP and the system supporting the ESP at the surface of the Earth and downhole in a wellbore drilled into the surface of the Earth.

DETAILED DESCRIPTION OF INVENTION

A comprehensive synchronous cable monitoring system for monitoring topside electrical supplies at the surface from the onsite generators, transformers, and ESP drive circuits for the purpose of monitoring harmonic content across the topside field cables at the surface is provided. The inventors are aware of no other manufacturer of distributed electrical sensing, providing much deeper insights into the entire health of the electrical system, directly monitoring locations such as ESP drive circuits, where harmful harmonic content can originate. This is achieved by deploying the inventor's passive sensors at key locations throughout the entire topside cabling network, providing the unique ability to monitor permanently, and then correlate, phase currents and voltages for synchronous harmonic content monitoring. This provides earlier and actionable warning of more cable failure modes than any other automated sensing technique, or manual inspection.

These data insights also enable operational cost savings by guiding condition-based maintenance approaches, better prepared and cost-effective interventions, and avoidance of unplanned outages. As the system acquires and builds more meaningful data sets over time, further savings may be expected from the identification of anomalies and trends which will optimize schedule maintenance, repair, and replace decisions and ultimately better inform aging asset life estimates.

This system enables permanent and synchronous power harmonics monitoring, acknowledging that downhole ESPs function as non-linear loads, drawing a distorted waveform that contains harmonics. These harmonics are losses of power which cause problems ranging from data transmission interference to degradation of conductors and insulating material in cable joints, rotating machines, and transformers. The system provides a measure of voltage stability, frequency, phase imbalance, power factor and total harmonic distortion.

It is important to gauge the total effect of these harmonics synchronously and permanently to gain a more cost effective, pre-emptive maintenance strategy. The ability to time-correlate all the above data with voltage at one end of the ESP drive circuit, and phase current monitoring for each ESP circuit, allows asset owners to diagnose nascent issues which can be proactively addressed to mitigate or avoid failure throughout the cable infrastructure. By monitoring voltage and phase current, synchronous and permanent harmonic content analysis of the entire field is possible, ensuring Power Quality (PQ) issues can be seen at source. To optimize cost and time to install, the measurement of voltage and current is to be made by secondary connection to existing current transformers (CT) and voltage transformers (VTs) wherever they are available. CTS and VTS are added to the ESP as needed. These are often located inside the switchgear, effectively from the ESP circuit.

Interrogator modules are provided as a rack-mount system, located in a central and climate-controlled location such as a substation relay room, for collating and publishing measurements from arrays of passive fiber optic sensors. Synthesis is provided in the inventor's data visualization and analysis platform. This will be provided in a rack-mount server format with an integrated web-based interface to access and visually correlate measurement data.

Photonic Current Transducers (PCT): Passive, fiber optic-networked current sensor, comprising an industry-standard split-core current transformer (CT) integrated with The inventor's photonic sensor technology. Photonic temperature transducer (PTT) sensors are provided that are attached on the ESP. The PTTS are passive fiber optic-networked temperature sensors. Temperature sensors are supplied with this system, to demonstrate interoperability of electrical and mechanical measurement and to observe and confirm any ESP overheating which could be evidential of impending failure.

In a particular embodiment of the invention, secondary-connected module-voltage (SCM-V) sensors are provided as secondary-connecting optically isolated sensors for voltage avoids the cost of stand-off insulators for the sensors by leveraging availability of existing VTs or other low-voltage sources to be digitized by the system. Voltage measurement is recommended for power quality analytics, but if access is not possible or affordable, current-based sensing may be used to provide early failure warnings via change over time in harmonic profiles by measurement location.

PCTs supplied shall be of split core type and therefore suitable for retrofit on terminated cables. Sampling phase current at all terminations and publishing at 4.8 kHz in real time enables profiling of circuit output current to the 100th harmonic from the topside transformer to the ESP in each circuit. Harmonics to the $200^{th}$ harmonic are presented by Fast Fourier transform of the voltage and current waveforms measured by the system.

Figure 9:
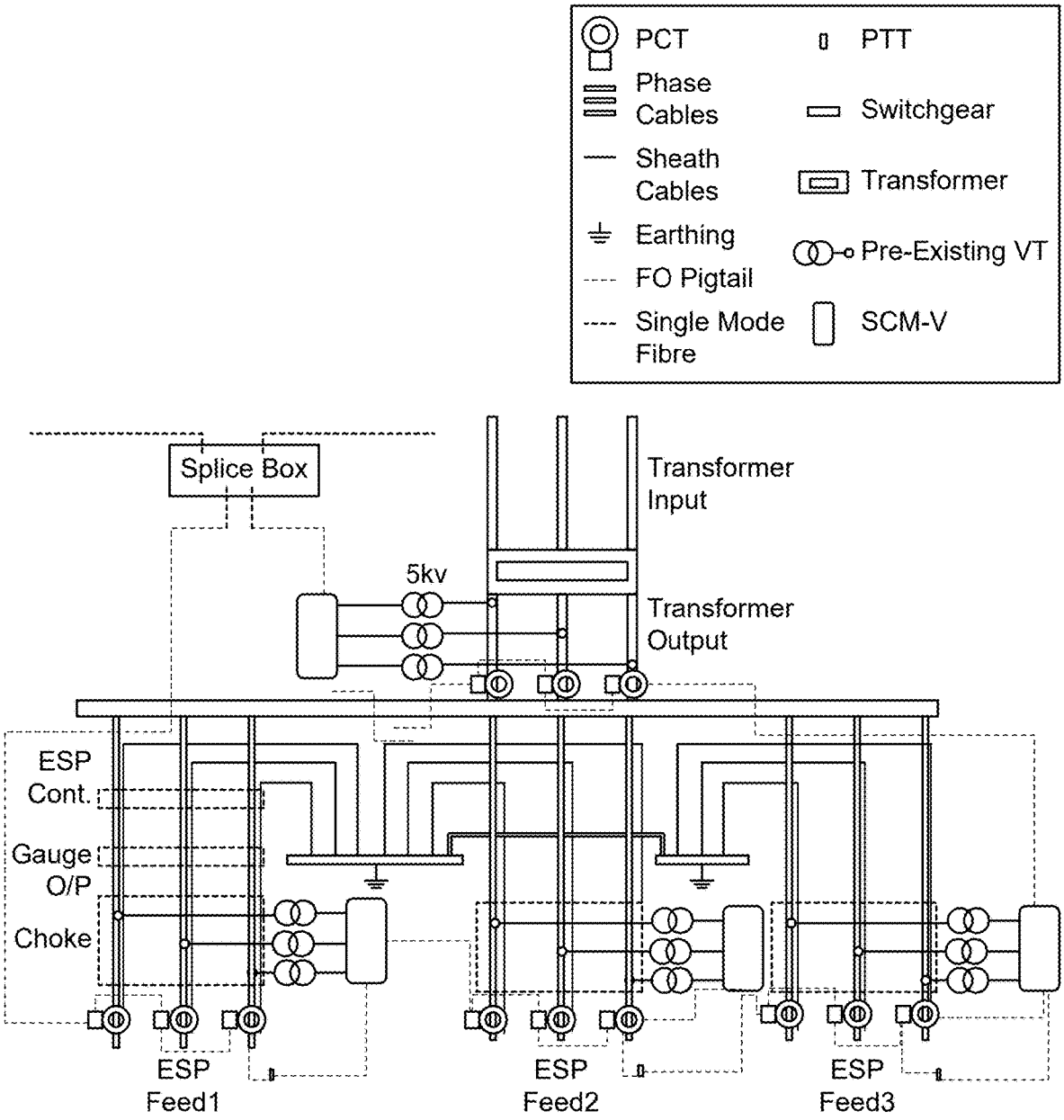
FIG. 9 depicts an interrogator unit, to be installed in an appropriate control room location on site.

The sensor array as illustrated in FIG. 9 shall be connected to the interrogator unit, to be installed in an appropriate control room location on site. The interrogator shall publish the data acquired from the sensor array in IEC 61850-9-2 Sampled Values. A server shall be provided to host The inventor's Synthesis software and medium-term data history. Backup is provided in a secure cloud or other offsite storage system the data held within any onsite server. This may be particularly useful to avoid local power supply interruptions and data loss, ensuring that no data is ever lost, and a much longer data history can be compiled and analyzed offline for trend analysis and future prognostics purposes. A gateway is provided between the interrogator, or PC server, and a well pad Scada system, to provide the end customer requires real-time data and alarms to be streamed directly to control systems.

Synthesis software is provided as a comprehensive visualization and analytics platform, designed to take full advantage of the unique capabilities, high frequency data rates and detailed insights generated by The inventor's distributed sensors. It permits data from all electrical sensors to be conveniently visualized in real-time and time-synced with mechanical data for both online and offline analysis. Acting as a data historian, Synthesis provides long-term trend information leading to powerful condition monitoring insights at unprecedented scale and detail to optimize scheduled and unplanned maintenance cost.

Synchronous waveform monitoring enables detailed capture of underlying factors within electrical waveforms, including transients or unusual events (such as arcing and switching) that affect nearby power system assets, such as transformers, circuit breakers, cables, and capacitors. This level of monitoring allows accurate asset health history to be maintained and assists in providing data for event classification and new failure pathology insights.

The synthesis software offers flexible deployment options. It can be based within the operator's private data network, supplied as a standalone hardware system (server supplied in this proposal), or delegated to an external secure cloud computing and storage environment. The integrated web-based interface offers customizable and secure access from multiple devices. In a particular illustrative embodiment of the invention, an onsite system is provided Alternatively a cloud-based data back up and offline analytics options are provided depending on the data management and data security requirements of the end user who is finally selected to host the trial.

The unique feature of the system's sensor technique is the ability to monitor electrical current and voltage waveforms synchronously with spot temperature measurements, remotely and passively. This provides near instantaneous and continuous visibility of the full detail of the sheath currents, with typical sampling rates of 4.8 (and soon, up to 14.4) kHz. Therefore, deviations in behavior, including electrical transients, be captured, and identified. This contrasts with simpler current measurements which only provide the root mean square (RMS) and lack detailed point-by-point information and may not be updated as frequently as preferred PCTs and PVTs described herein in a particular illustrative embodiment of the invention.

Figure 10:
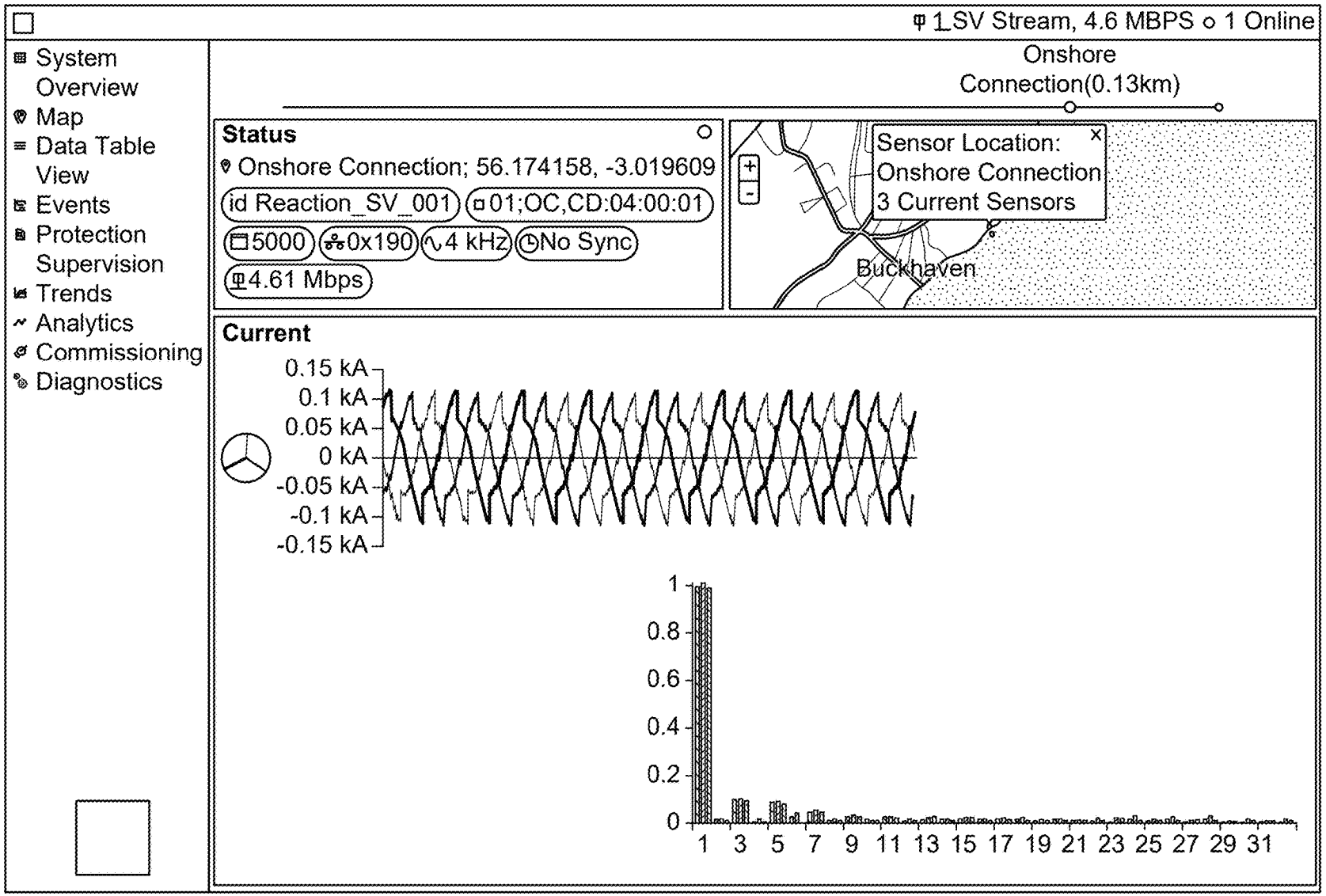
FIG. 10 depicts options that can be readily derived and analyzed from waveform data.

Fast-changing electrical transients indicate abnormal operation or asset health degradation. As illustrated in FIG. 10, such options can be readily derived and analyzed from waveform data. Current waveforms can also be precisely correlated with temperature and voltage measurements from PTTs, PVTs, SCMs, and other data sources.

The inventor provides rack-mount components for installation in a substation 19" rack. The Interrogator shall interface with the sensors using a small number of the existing single mode fibers in the bundles present. The inventor's sensors shall be spliced into the existing fiber network at suitably located splice boxes.

The present invention's instrumentation scheme has several functional and operational benefits over conventional measurement schemes: Minimal optical fiber usage. Uses substantially fewer fibers than conventional networked digital sensor systems. Each fiber (single ended) may be used to deliver dozens of measurements to the central Interrogator. No power supplies, telecoms, or time-sync equipment required at any measurement point. The interrogator is the only powered device in the system, while every sensor is completely passive and requires no local time synchronization signal or active digital telecoms. The present invention' system is quicker and easier to install, with each sensor requiring only mechanical mounting and standard single mode fiber splicing to install. This in turn simplifies installation and reduces installation costs, compared with conventional or alternative digital measurement technologies.

In a particular illustrative embodiment of the invention, the Interrogator system publishes measurements in the IEC 61850-9-2 Sampled Value format over Ethernet for acquisition, storage, and analysis by Synthesis, and use by other IEC 61850-compliant equipment that a user may conFIG, to subscribe to the published measurement data.

For timestamping of measurement samples, the system provides a time synchronization source, such as a GNSS or GPS clock. This will synchronize each measurement using the IEC/IEEE 61850-9-3 Precision Time Protocol (PTP).

The PCT consists of an industry-standard iron-core CT, the secondary circuit of which is instrumented by The inventor's unique passive instrumentation technology. Compared to conventional electrical sensors or Rogowski coil devices, which require significant supporting infrastructure at each installation location, the PCT grants significant reduction in complexity, and improvements in safety and ease of installation. A sample drawing of a PCT is shown in FIG. 10. The final design of the CT components will be subject to the expected current rating and available space at the installation location. A Secondary-Connected Module (SCM) is depicted in FIGS. 12*a*, 12*b*, 12*c* and 12*d*. The SCM consists of a 1U rackmount unit to which the three phase secondary voltages from existing VTs may be connected via a standard ring terminal block.

Figure 11A:
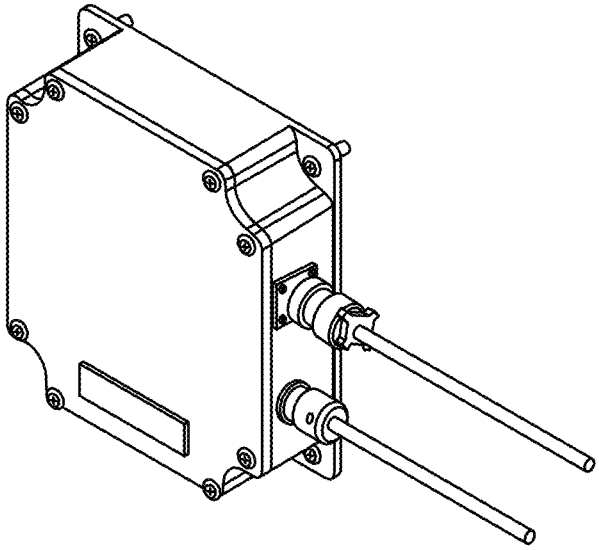
FIGS. 11*a*, 11*b* and 11*c* depict three Photonic Temperature Transducers (PTTs) as depicted in FIGS. 12*a*, 12*b*, 12*c* and 12 *d* depict a Secondary-Connected Module (SCM)
Figure 11B:
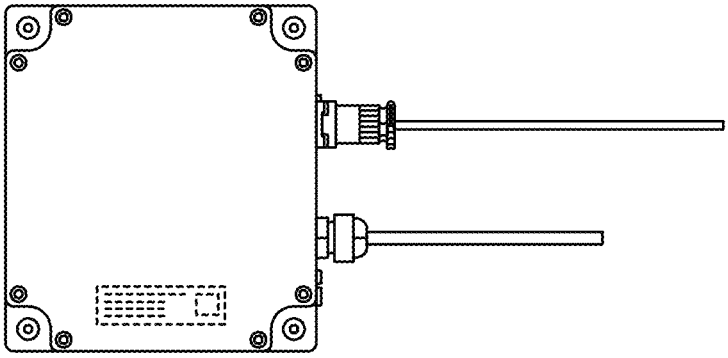
Figure 11C:
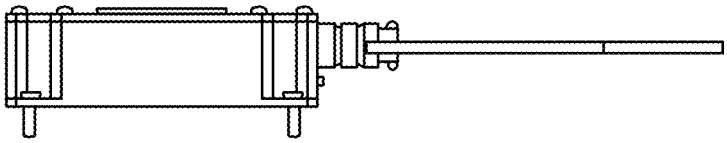
Figure 12A:
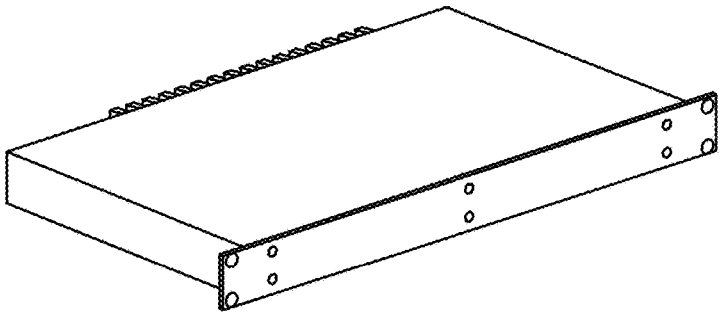
Figure 12B:
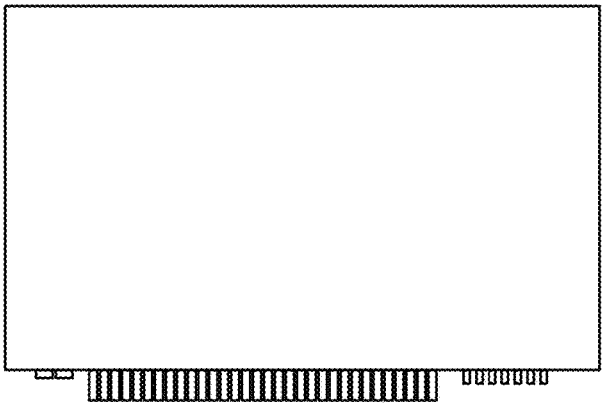
Figure 12C:
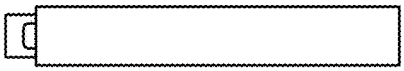
Figure 12D:
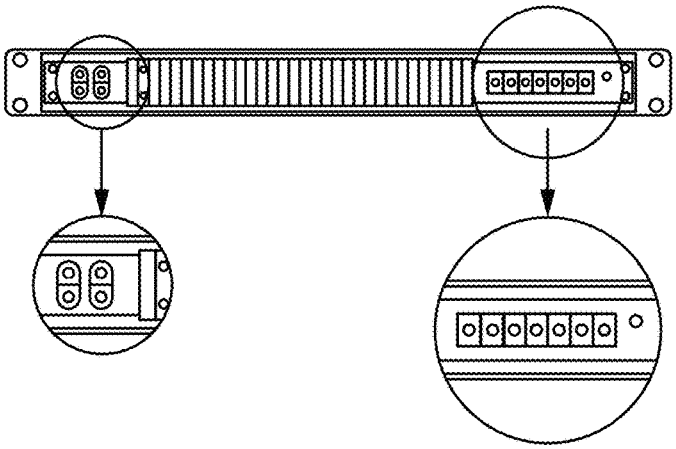

Three Photonic Temperature Transducers (PTTs) as depicted in FIGS. 11*a*, 11*b* and 11*c* are included along with the electrical system to measure the ambient temperature. The PTT comprises a small metallic or plastic patch containing the optical temperature gauge and fiber optic pigtails for integration into the optical network. The gauge is easily bonded to the measurement surface using epoxy or by any mechanical means. All uses of the word "surface" herein are defined as the "surface of the Earth."

In a particular illustrative embodiment of the invention a system interfaces between an Electrical Submersible Pumping system and a sensor unit that incorporates and consolidates inputs from Fiber Optic and other sensing devices (including piezoresistive, wireless and quarts sensing devices) located at or near an in-well electrical submersible pump system. An adapter that connects between the ESP motor and an ESP sensor that acts as a conduit to accept connections from the ESP motor (e.g. temperature, current and voltage transformer outputs, proximity sensors etc.) and external sources and conveys those connections to the ESP sensor for consolidation and processing. The system incorporates voltage transformers VTs to allow for the extraction of electrical information from an in-well electrical submersible pump drive motor. The system also incorporates electrical fiber optic and may incorporate hydraulic conduits. The system enables communication of consolidated inputs information either via a fiber optic cable connected to a processor in the system or data transmitted via a superimposed signal on the Electrical Cable used to provide electrical power to the ESP.

An Electrical Submersible Pumping system used in production wells for the purpose of producing single or multiphase flow from a reservoir containing fluids. The system provides waveform data comprising electrical spectrum information directly from an operating in-well electrical submersible pump drive motor. The electrical spectrum information contains frequency based spectral data up to the 200th harmonic by applying a Fast Fourier transform to the waveform data.

The system directly monitors the speed of rotation of the in-well electrical submersible pump drive motor using a proximity sensor located at or near the bottom of the shaft of an electrical submersible pump motor. In a particular illustrative embodiment of the invention the system provides a temperature profile along the windings and at the head of the in-well electrical submersible pump drive motor by incorporating a fiber optic cable within the motor windings during manufacture. The system provide duality of the system using both a fiber optic cable and the ESP power cable to provide full communication, even with a grounded leg on the ESP cable. The system provides valuable outputs which can be used to prevent premature failure of the ESP system. The system provides outputs to allow for the system to be operated more efficiently electrically by maximizing real power.

The system provides the ability to detect and local faults using fiber optic cables by monitoring transient gradients and the health and integrity of the ESP insulation system along its length. A system output provides a more accurate insight and analysis that can better predict when the electrical failure of the ESP system may occur than prior systems.

In an illustrative embodiment of the invention, an ESP monitoring system is provided using a downhole sensor package attached to an ESP and a fiber optic cable. The ESP sensing system continues to operate and transmit data even after a down hole ESP power cable has been grounded and cannot transmit data over the downhole ESP power cable. Analysis of harmonics and power quality up to the one hundredth harmonic and above up to the 200th harmonic are measured and analyzed. Transient peaks along the complete cable run are measured and analyzed along with measures of electrical frequency to diagnosis problems in the ESP.

The system enables prevention of destructive events at the ESP, such as overheating, vibration, electrical damage, and harmonic distortion. Downhole gauge enhancements are provided to measure ESP motor rotational speed of the ESP motor shaft, a 3-Phase voltage & current at the ESP motor; and measurement of real vibration in all 3 axes on the ESP. When the harmonics start to increase, this increase indicates that the surface and subsurface components need to be examined or repaired for possible degradation or failure. The ESP power and voltage information also enables determination of a power factor (PF) and power quality (PQ) for the power being provided to power the ESP. The PF is adjusted at the surface using a filter, such as a common mode filter (CMF) or a sine wave filter (SWF) by the filters adding inductance and or capacitance, optimizing a set point within the frequency spectrum of the ESP. The SWF and CMF are useful in adjusting the PF and PQ, adding resistance and capacitance to adjust the PF and PQ.

Power factor is an expression of energy efficiency. It is usually expressed as a percentage—and the lower the percentage, the less efficient power usage is. Power factor (PF) is the ratio of working power, measured in kilowatts (kW), to apparent power, measured in kilovolt amperes (KVA). Apparent power, also known as demand, is the measure of the amount of power used to run machinery and equipment during a certain period. It is found by multiplying (kVA=V×A). The result is expressed as kVA units. To calculate power factor, you need a power quality analyzer or power analyzer that measures both working power (KW) and apparent power (kVA), and to calculate the ratio of kW/KVA. The power factor formula can be expressed in other ways: PF=(True power)/(Apparent power) OR PF=W/VA. Where watts measure useful power while VA measures supplied power. The ratio of the two is essentially useful power to supplied power. The power factor compares the real power being consumed to the apparent power, or demand of the load. The power available to perform work is called real power. You can avoid power factor penalties by correcting for power factor. Poor power factor means that you're using power inefficiently. This matters to companies because it can result in heat damage to insulation and other circuit components; reduction in the amount of available useful power; and a required increase in conductor and equipment sizes. The power factor increases the overall cost of a power distribution system because the lower power factor requires a higher current to supply the loads.

A processor optimizes the performance of the ESP motor and the PF by adjusting the voltage and frequency of the power supplied to the ESP. For example, in an example, a surface voltage measured at 60 volts should cause the ESP motor to run at 3,500 revolutions per minute (RPM). When the measurements at 60 volts indicate the ESP motor is now running at 3,300 RPM this indicates an issue, which could be a pump dragging or something else going on downhole causing the operator to get less performance than expected on an ESP pump performance curve (pump RPM v. pump voltage Frequency) than expected.

ESP motors can be deployed at 2,000 feet or 10,000 feet and voltage losses along the cable can be determined by the ESP sensors and transmitted to the surface over the fiber optic cable so that the voltage losses can be compensated for to cause the ESP motor to run at the most efficient point on the ESP pump operating curve. When the harmonic distortion goes up at the same operating voltage, this indicates degradation in the surface electronics or downhole so that the problem can be corrected. Rotation speed of the shaft is determined from the voltage and frequency sent up hole at the surface over the fiber optic cable. The rotational speed can be compared to a proximity sensor on the spline of the motor shaft. Downhole frequency is derived from the voltage frequency which can be validated against and compared to the rotational speed measured by the proximity sensor to validate the operation of the fiber optic data frequency indicating the rotation speed of the motor. The CTs and PTs are attached to the bottom of the motor where the spline of the motor is located.

The system automatically adjusts the impedance of the cable by adding capacitance and or inductance so that the voltage at the ESP as seen by the power supply at the surface so that the ESP pump runs at a desired point on an ESP pump performance curve for substantially optimal performance. The system automatically adjusts the impedance of the cable and ESP seen by the power supply to adjust the power factor of voltage used at the ESP motor.

In a particular illustrative embodiment of the invention, a system and method are provided for ESP monitoring, sensing and predictive diagnostics is provided using a fiber optic cable, a sensor package at the ESP and a sensor package interface. The system and method disclosed provide for improved accuracy in analysis and prediction of operational problems of an ESP and a power supply connecting cables to the ESP operating downhole. The ESP system and method continue to operate and transmit data even after a down hole power cable has been grounded and cannot transmit data over the downhole power cable.

A detailed description will now be provided. The purpose of this detailed description, which includes the drawings, is to satisfy the statutory requirements of 35 U.S.C. § 112. For example, the detailed description includes a description of inventions defined by the claims and sufficient information that would enable a person having ordinary skill in the art to make and use the inventions. In the FIGs, like elements are indicated by like reference numerals regardless of the view or FIG, in which the elements appear. The FIG, s are intended to assist with the description and to provide a visual representation of certain aspects of the subject matter described herein. The FIGs are not all necessarily drawn to scale, nor do they show all the structural detail, nor do they limit the scope of the claims.

A particular illustrative embodiment of the invention is disclosed as an Electric Submersible Pump Downhole Monitoring and Diagnostics System and Method. In a particular illustrative embodiment of the invention, electrical and operational parameter measurements of an ESP and connecting cabling and analysis of harmonics and power quality up to the one hundredth harmonic are measured and analyzed. Transient peaks along the complete cable run are measured using a fiber optic cable and analyzed along with measures of electrical frequency along with three phase voltage and current at an ESP motor.

In a particular illustrative embodiment of the invention, a processor implements artificial intelligence (AI) and machine learning (ML) to monitor ESP voltage, ESP current voltage frequencies, power cable transient voltage peaks, pump rotationally speed to predict system failures and adjust frequency and voltage at the ESP motor to make the ESP pump run at a desired substantially optimal point on a pump performance curve for efficient operation. The process also uses AI and ML to adjust the impendence of the ESP system, power supply cable and ESP motor to obtain a substantially optimal power factor for power consumed by the ESP.

In a particular illustrative embodiment of the invention, these electrical and operational measurements for the ESP motor and cabling are analyzed to reduce operational expenditures associated with ESP installations. In a particular illustrative embodiment of the invention, increased data accuracy is provided over fiber optic cables to enable diagnosis, prediction, and prevention of destructive events at the ESP and ESP support system including the power supply cable to the ESP, such as overheating, vibration, electrical damage, and harmonic distortion at the ESP and the ESP support system including the power supply cable to the ESP. The system and method enable monitoring, diagnostics, and preventative analytics. Existing ESP downhole gauge enhancements are provided to measure directly at the ESP motor, including but not limited to rotational speed of the ESP motor shaft, 3-Phase Voltage, and electrical current directly at the ESP motor along with measurement of real vibration in all 3 axes of the ESP on the ESP.

In another particular illustrative embodiment of the invention, the electrical measurements and further operational parameters are measured and analyzed. In a particular illustrative embodiment of the invention an ESP gauge is provided with sensors that couple with Gauge Parameters, namely, Intake Pressure, Discharge Pressure, Intake Temperature, Motor Temperature, Vibration-X-Y-Z, Current Leakage, Voltage, Electrical Conditions, Wye Point Voltage, and Gauge Input Voltage.

Figure 13:
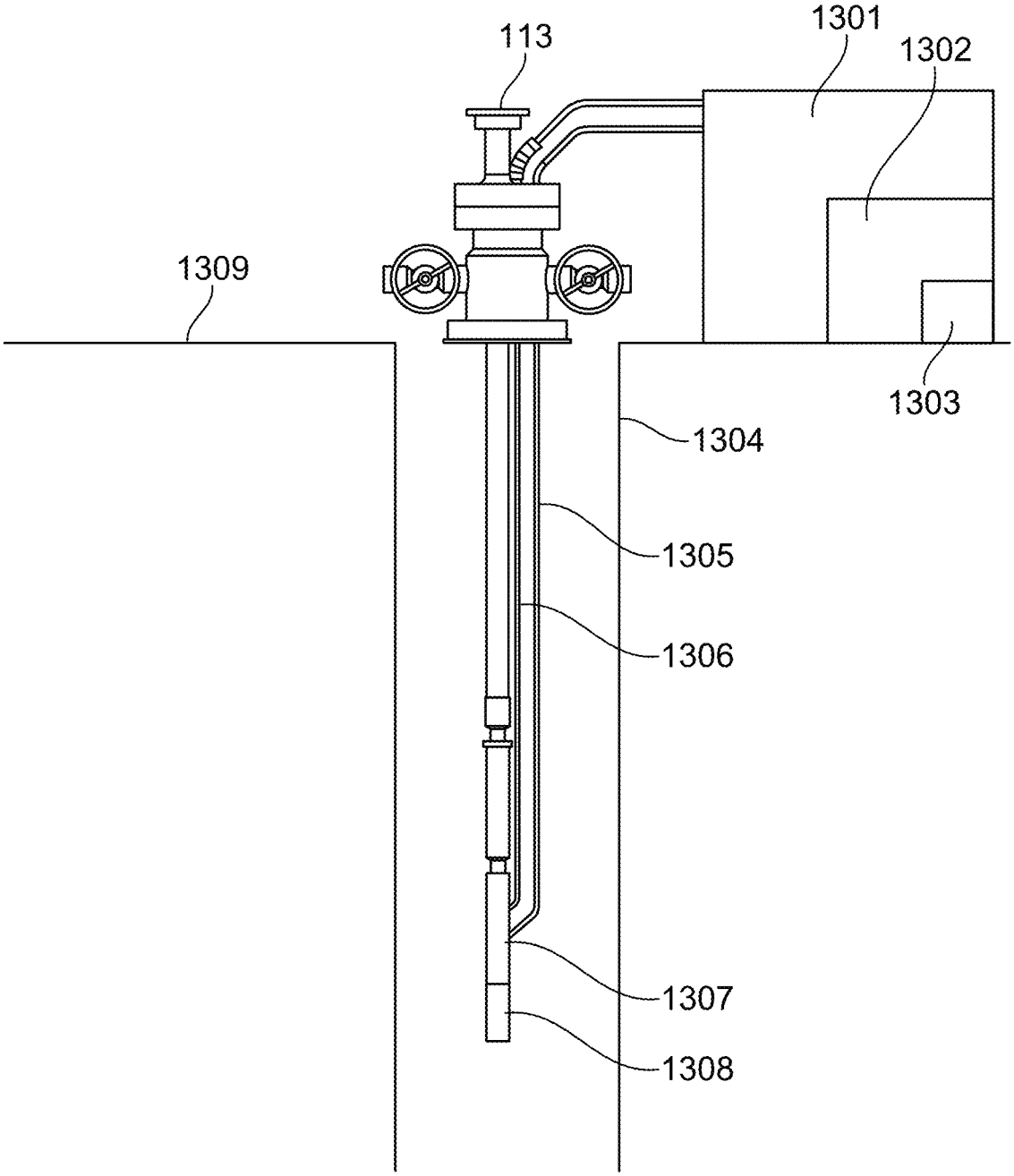
FIG. 13 depicts a schematic representation of the electric submersible pump downhole monitoring and diagnostics system deployed down hole in a wellbore.

FIG. 13 depicts a schematic representation of an illustrative embodiment of the invention, wherein a surface monitoring system monitors the downhole monitoring system. All surface system components described herein, including but not limited to, electrical equipment, non-electrical equipment and software on the surface are collectively referred to herein as a "Surface Monitoring System." All downhole system components described herein, including but not limited to, electrical equipment, electrical sensors, non-electrical sensors, junction boxes and software beneath the surface are collectively referred to herein as a "Downhole Monitoring System." As shown in FIG. 13, a surface monitoring system 1301 including, but not limited to, a processor 1302 in data communication (exchanging data with) with a non-transitory computer readable medium 1303. A computer program containing instructions for execution by the processor is stored in the computer readable medium. As shown in FIG. 13, an electrical submersible pump 1307 is deployed into a wellbore drilled in the surface of the Earth 1309.

A power cable 1306 supplies power from the surface to the ESP. A fiber optic cable 1305 runs along side the power cable and attaches to the ESP monitoring electronics 1308 mounted on or near the ESP. The ESP is suspended downhole from a wellhead 113.

Turning now to FIG. 1, as shown in FIG. 1, in a particular illustrative embodiment of the invention, a Surface Interrogator, Software, Transducers, Data from vent box to Interrogator, Secondary source-oscilloscope, Modbus protocol, Tiered Offering/Phases, and Back to back pads/8 ESPs per pad.

As shown in FIG. 1, a particular illustrative embodiment of the invention 100 is depicted. As shown in FIG. 1, the first ESP 101 and a second ESP 103 are connected to an interrogator box 102 from which data is uploaded through a MODBUS protocol to a SCADA communication protocol. A surface choke 105 and electronics including but not limited to three power transformers (PTs) and three current transformers (CTs) 108 are provided inside an enclosure. A fiber optic cable 106 and surface power cable 107 are also provided. A fiber optic cable 110 is strapped to a surface power cable to ESP2. A second junction box 111 is provided between a wellhead and the fiber optic cable and surface power cable. A first junction box 109 is provided between a wellhead 113 and the fiber optic cable 106 and surface power cable 107.

As shown in FIG. 1, a first and second ESP having a variable speed drive are provided. Enclosure 103 is provided between each enclosure and an ESP. Three power transformers and three current transformers are provided inside enclosure 105. A fiber optic cable 105 is provided and strapped (108) to a surface 107. Junction box 111 contains three power transformers, three current transformers are grouped inside junction box 109. Junction box 111 is attached to the well head 110.

Figure 2:
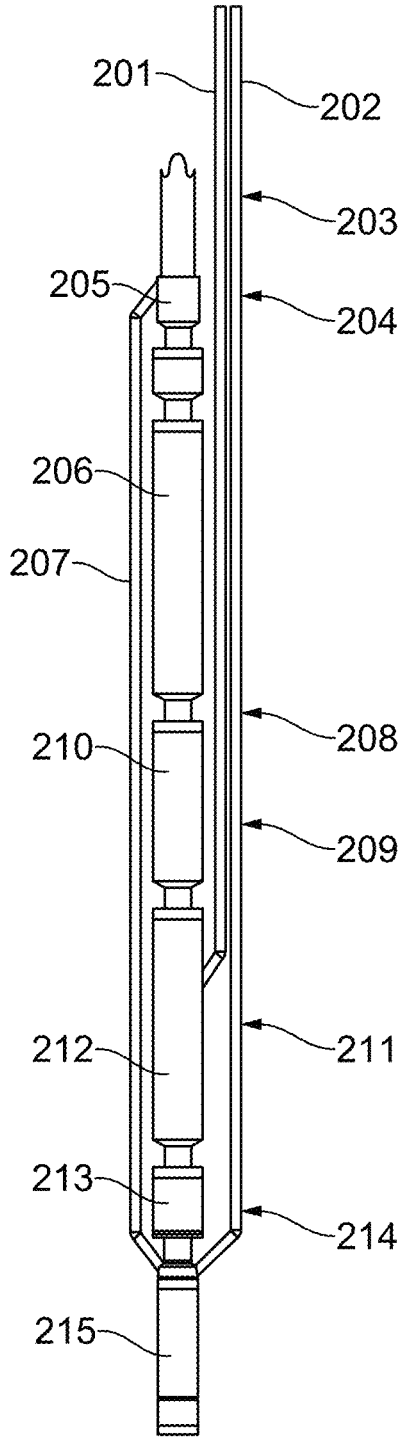
FIG. 2 is a system view of a particular illustrative embodiment of the invention in a downhole setup for data gathering along an ESP string.

As shown in FIG. 2, in a particular illustrative embodiment of the invention 200, a downhole ESP provides an interrogator, software, transducers, motor test lab and Modbus protocol. As shown in FIG. 2, a downhole power cable 201 is provided from up hole to a motor 212, a fiber optic cable 202 from up hole to an ESP gauge 215. The fiber optic cable reads sensors that indicate intake pressure and fluid temperature 208, velocity of fluid past motor 209, variation of motor temperature 211 and motor temperature. A pump 206, capillary tubes for intake pressure 207, a seal 210, motor 121 and motor base 213 are provided. FIG. 2 is a system view of a particular illustrative embodiment of the invention in a downhole setup for data gathering along an ESP string.

As shown in FIG. 2, a downhole power cable 201 and a fiber optic cable are provided. A discharge 205, pump 206, capillary tube discharge pressure 207, a seal 209, motor 211, motor base 213 and ESP gauge 215 are provided. The fiber optic cable senses and transmits a measurement of transient peaks along the power cable 203. The fiber optic cable senses and transmits a measurement discharge pressure and fluid temperature 204. The fiber optic cable senses and transmits a measurement of intake pressure and fluid temperature 208. The fiber optic cable senses and transmits a measurement of velocity of fluid past motor 209. The fiber optic cable senses and transmits a measurement of vibration and motor temperature 211. The fiber optic cable senses and transmits a measurement of motor temperature 214.

Figure 3:
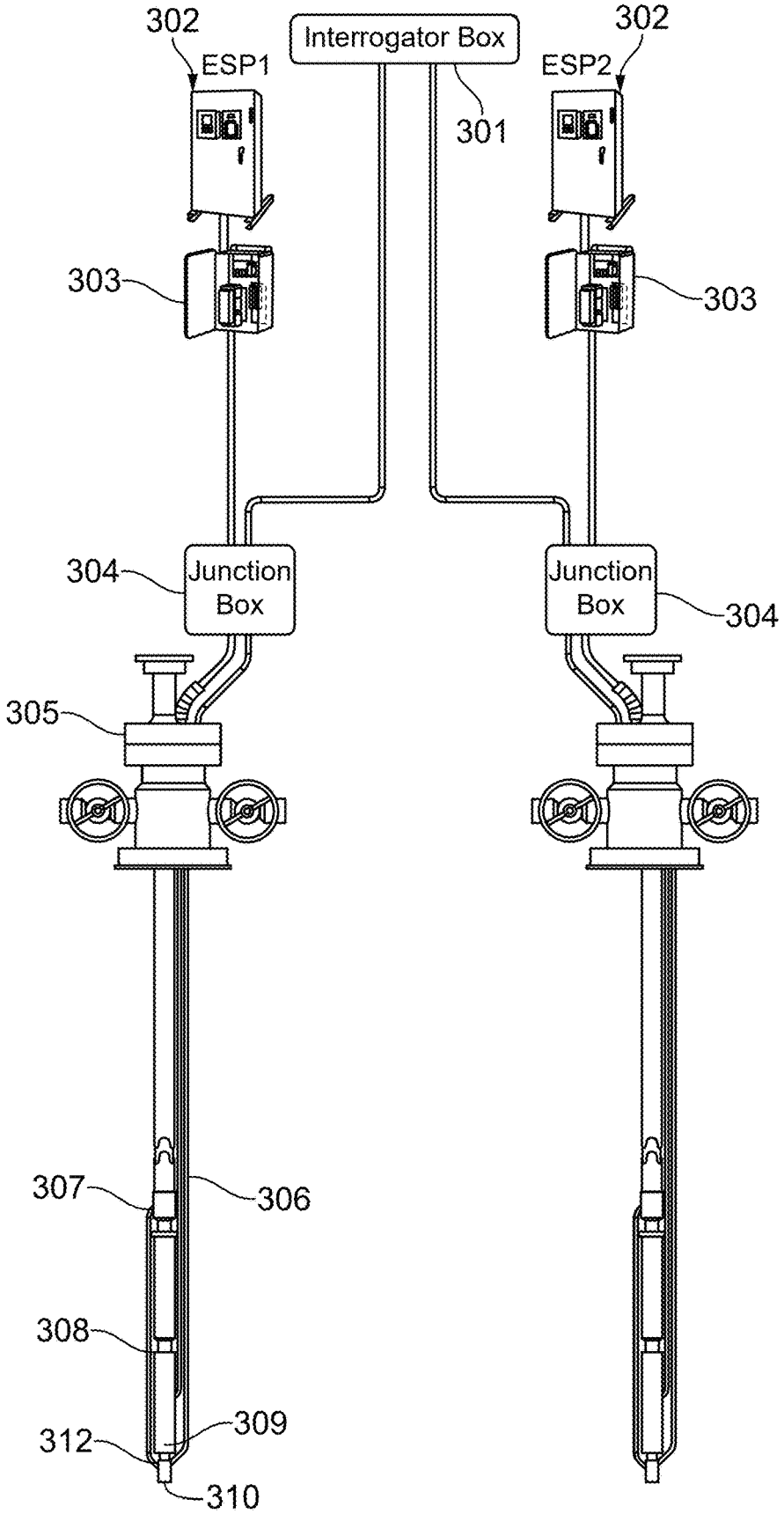
FIG. 3 shows a system diagram of an actual system and method in a deployed configuration.

Turning now to FIG. 3 as shown in FIG. 3, in a particular illustrative embodiment of the invention, an interrogator box 301 is provided to upload data in SCADA communication protocol. FIG. 3 shows a system diagram of an actual system and method in a deployed configuration. A first ESP 302 having a variable speed drive and a second ESP 302 are provided. A surface choke 303 is provided in an enclosure. A junction box 304 is provided to connect a fiber optic cable and a surface power cable to a well head 305. The fiber optic cable 306 is strapped to a down hole power cable. Sensors provides a measurement of discharge pressure 307, motor temperature 308, intake pressure 312 and motor base electronics 309 having 3 power transformers (PTs), 3 current transformers (CTs), 3-phase voltage, 3-phase current, and vibration harmonics. An ESP gauge 310 is provided.

As shown in in FIG. 3, an interrogator box 301 is provided to upload data from a fiber optic cable to a surface processor, including a computer readable medium containing instructions that are executed by the processor. An ESP variable speed drive 302 for a first ESP, ESP1 is provided having a variable speed drive 302. A surface choke 303 is provided to filter a signal from the power cable. A junction box 304 is provided as an interface between a well head 305 and the fiber optic cable and the down hole power cable. The fiber optic cable 306 is strapped to the down power cable. The fiber optic cable reads a sensor and reports discharge pressure 307, motor temperature 308, intake pressure 309 and motor base 309 with 3 PT'S, 3 CT'S, 3 phase voltage, 3 phase current, vibration, and electrical harmonics. An ESP gauge 310 is provided for sensing and transmission of sensed data to the surface via the fiber optic cable.

Figure 4:
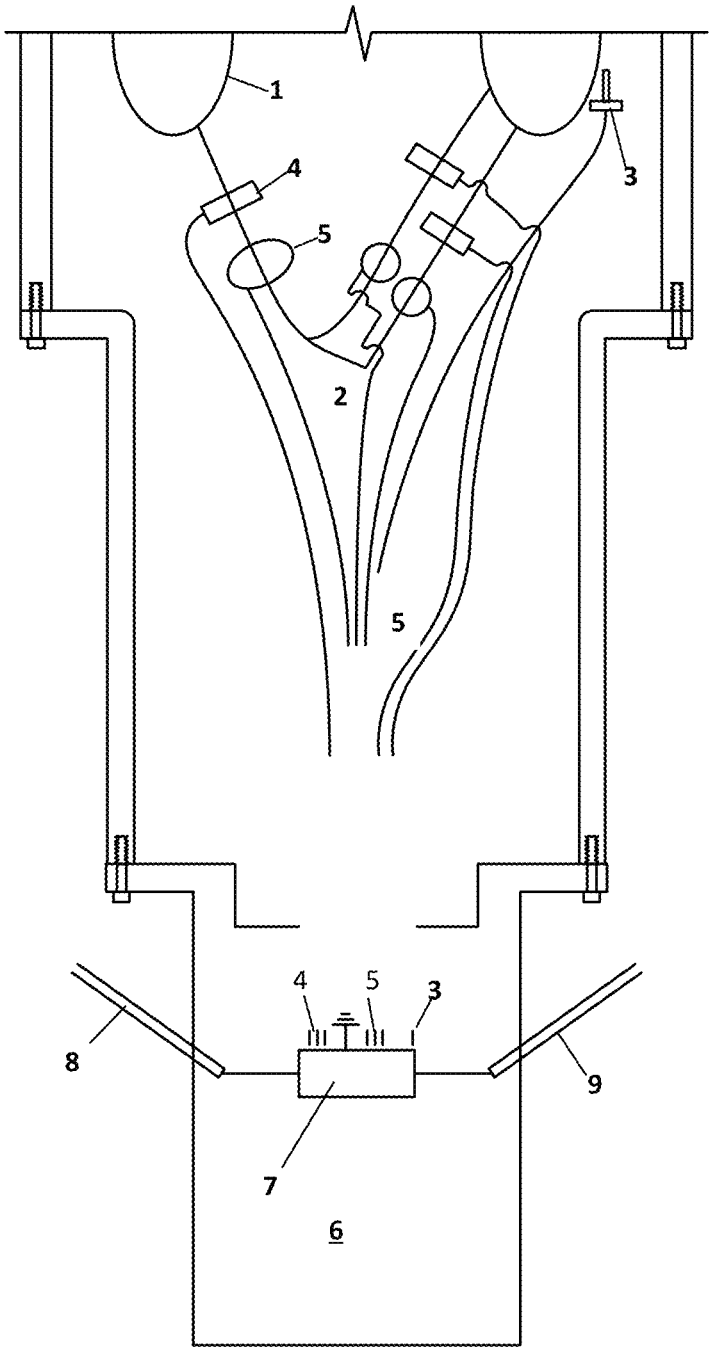
FIG. 4 depicts a particular illustrative embodiment of the invention showing an existing bottom end turns of the stator winding.

Turning now to FIG. 4, FIG. 4 depicts a particular illustrative embodiment of the invention showing an existing bottom end turns of the stator winding 1. Three Phase with a Neutral (referred to as the Y point). At 2 depicts a motor Y point is the zero voltage point of the three phase winding in the motor. At 3 depicts a fiber optic thermocouple imbedded in the base of the motor winding to record motor temperature and provide a temperature reading to use as a motor protection point. At 4 depicts a voltage Potential Optical divider. This will reduce the voltage to a 100:1 ratio in order to transmit actual motor voltage through the fiber cable to the surface interrogator. 3 phase plus a ground for L-L and L-G values. 5 depicts a Current Potential Optical Transformer supplies motor current readings through the fiber optic cable to the interrogator. 3 Phase current. At 6 depicts an existing downhole gauge or sensor which will house the downhole fiber optic termination block. 7 depicts a fiber optic downhole termination block which will interface all downhole data collection and send this information through the fiber cable to the interrogator. 8 depicts a Fiber Optic cable from the surface into the downhole block. 9 depicts a Fiber optic pressure transducer to be mounted at the pump discharge to send discharge pressure readings to the terminal block and then to the surface. Additional fiber optic temperature transducers are mounted at the top of the motor near the motor lead terminal block. Additional fiber optic RPM and vibration (X,Y,Z) are mounted at the base of the rotor shaft to sense speed and vibration.

Figure 5:
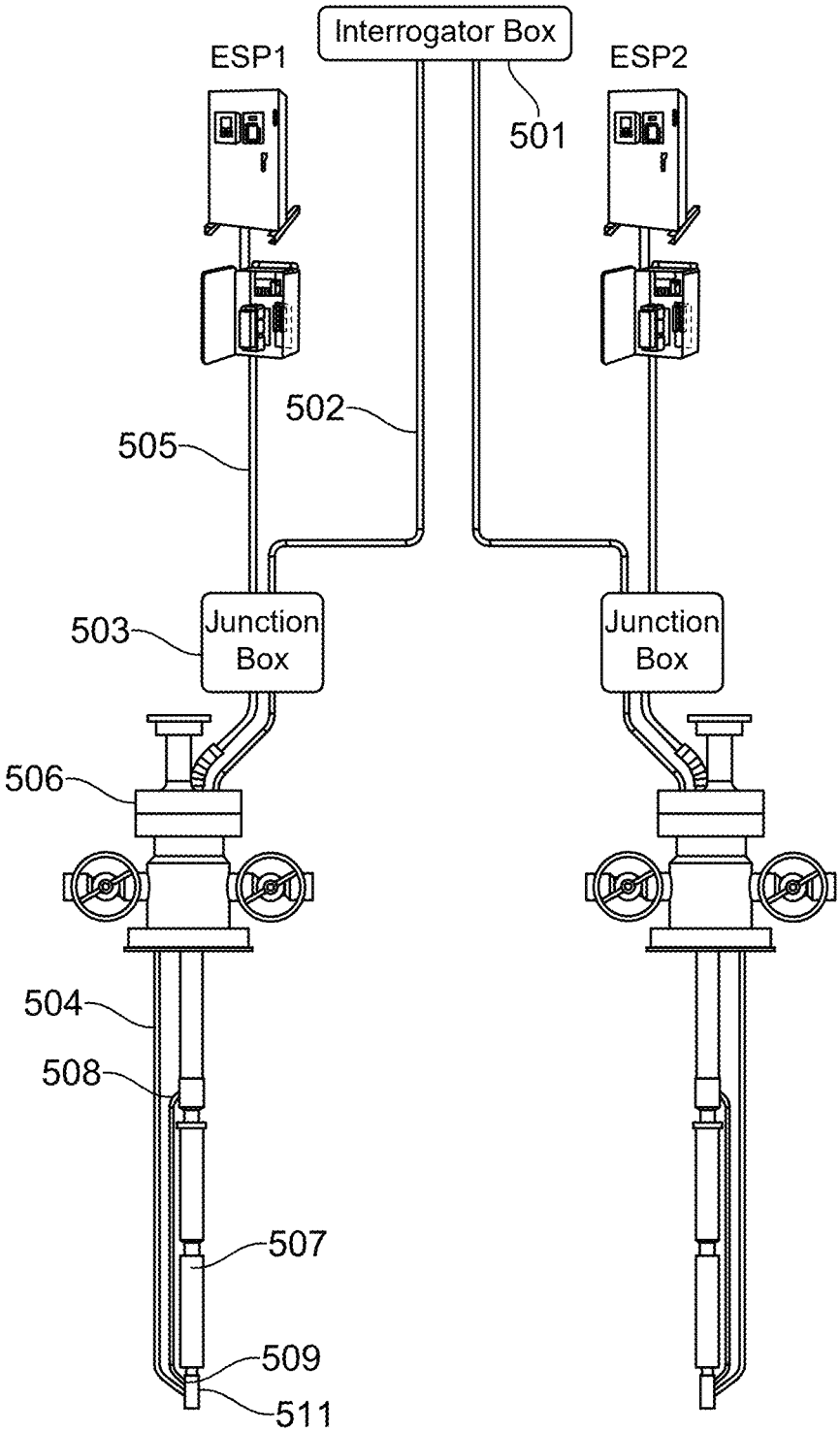
FIG. 5 depicts a schematic representation of a particular illustrative embodiment of the invention.

Turning now to FIG. 5, FIG. 5 depicts a schematic representation of a particular illustrative embodiment of the invention. As shown in FIG. 5, interrogator 501 connects 502 to a fiber optics junction box 503. A fiber optic cable 504 is strapped to a down hole cable 505. Junction box 503 is connected to wellhead 506. An ESP is connected to the wellhead 506. An ESP 507 is connected to well head using the downhole cable and the fiber optic cable. CTs and PTs are located in ESP motor base. The CTs and PTs measure vibration, harmonics for three phase current and 3 phase voltage. Sensors on the ESP motor measure discharge pressure 508, intake pressure 509. These measurements are transmitted through the fiber optic cable to the interrogator through the junction box.

Figure 6:
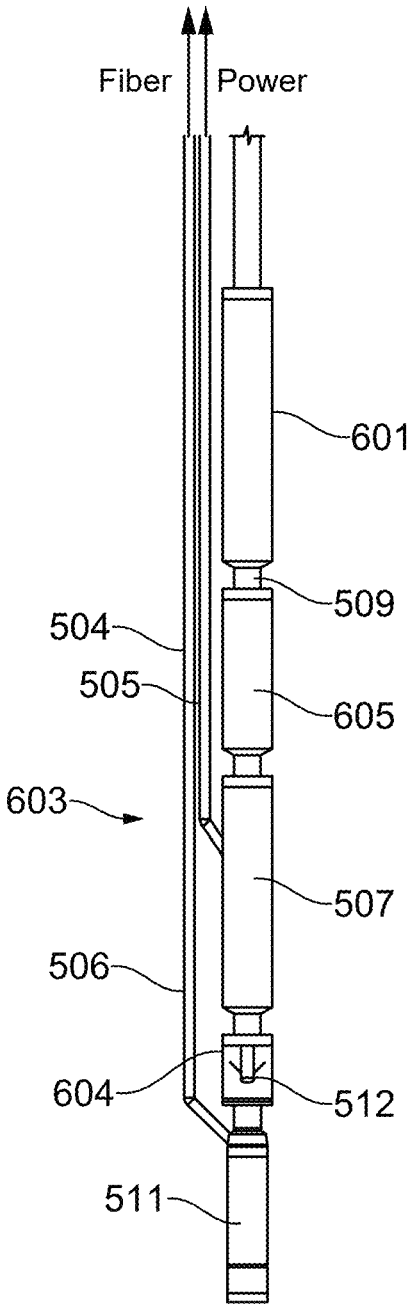
FIG. 6 depicts a schematic representation of a particular illustrative embodiment of the invention.

Turning now to FIG. 6, FIG. 6 depicts a schematic representation of a particular illustrative embodiment of the invention. As shown in FIG. 6, fiber optic cable 504 terminates into ESP motor base 512 adjacent to an existing gauge 511. Power cable 505 terminates into ESP motor 507. Sensors on the motor measure motor vibration 604, motor temperature 603 and transmit the measurements to the surface through fiber optic cable 504. Seal 605 is positioned between the ESP pump 601 and the ESP motor 507.

Figure 7:
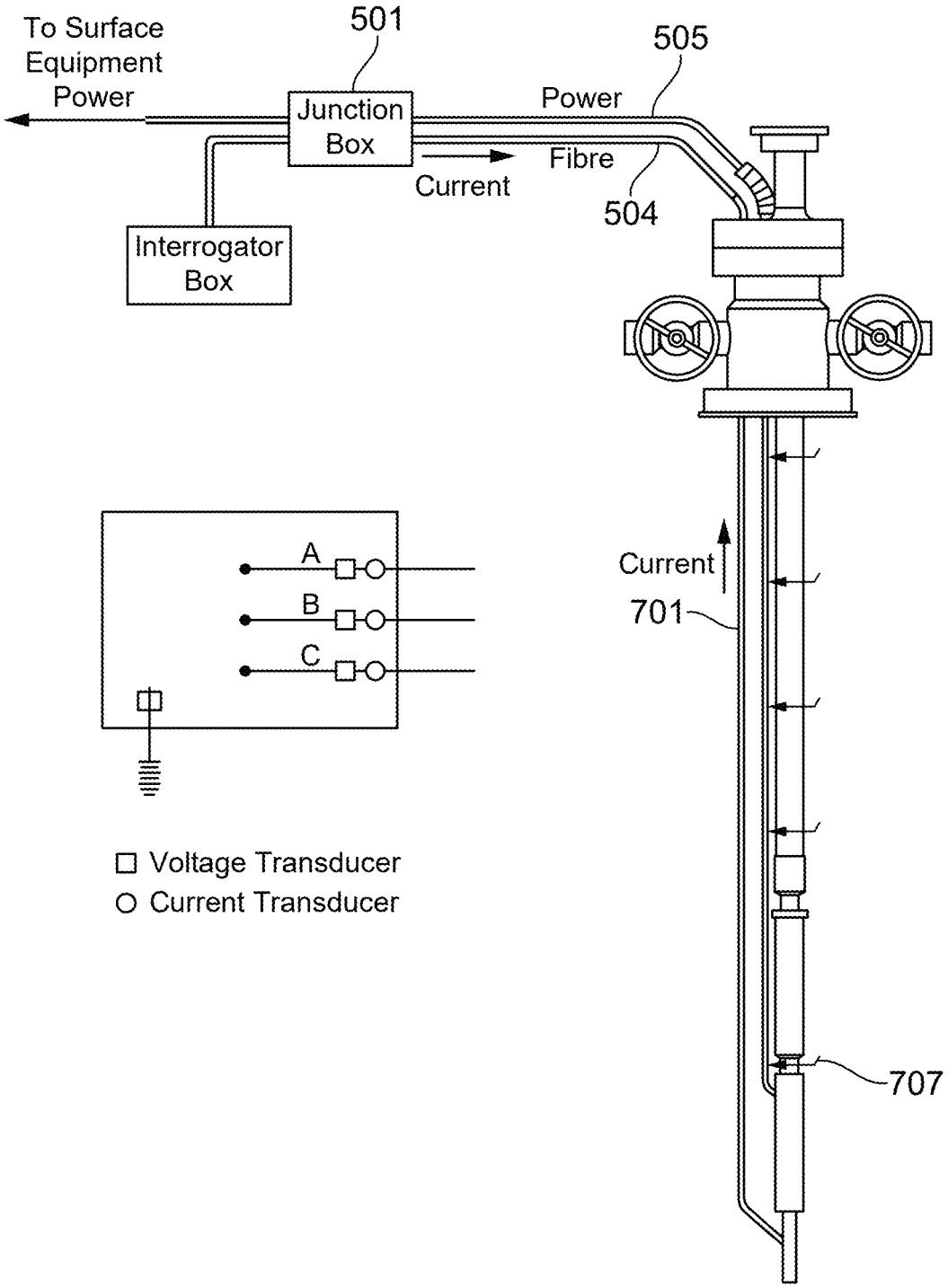
FIG. 7 depicts a schematic representation of a particular illustrative embodiment of the invention.

Turning now to FIG. 7, FIG. 7 depicts a schematic representation of a particular illustrative embodiment of the invention. As shown in FIG. 7, fiber optic cable 504 is deployed adjacent to the power cable 505. The fiber optic cable senses a ground fault location 710 so that an operator need only withdraw the ESP cable to the fault location rather the entire ESP cable run. As shown in FIG. 7, an example fault location, a 40% impedance change indicates a fault 3,200 feet from the surface on an 8,000 foot run. The measurements are transmitted through the fiber optic cable to the interrogator.

An initial baseline impedance for the power cable is measured, using for example an ohm meter, for purposes of discussion, the initial impedance is measured at 10 ohms. Later when an electrical anomaly such as a reversal of current on the fiber is observed on the fiber optic cable or a or a change in a waveform from the power cable is observed over the fiber optic cable is observed, the impedance of the power cable is measured again. The change in waveform indicates a ground fault on the power cable. In another instance, the change in waveform indicates a pending failure of the insulation in the power cable. When a fault in the power cable is observed, the impendence of the waveform is measured again and for example, the new impedance of the power cable is now 4 ohms, this indicates that the ground fault is at 40% of the power cable length or 3,200 feet for an 8,000 foot long power cable. Thus, only 3,200 feet of power cable need be withdrawn from the wellbore to repair the fault, instead of withdrawing the entire 8,000 feet of power cable to test and repair. This improvement saves time and money by withdrawing 3,200 feet of power cable. The cable length is measured from the surface to the ESP motor.

In a particular illustrative embodiment a PX800 Yokogawa is provided to perform FFTs on harmonics up to $500^{th}$ Harmonic based on the waveforms sent from the power cable and ESP motor over the fiberoptics.

Reflection points 707 will show anomalous waveform behavior along the power cable. Reflection points 707 are points where a change in the waveform is detected at the processor, such as a spike or change in a harmonic indicated in the waveform from the power cable is transmitted over the fiber optic cable, which indicates a potential pending fault when a ground in the power cable is not indicated. The power cable and power cable insulation has capacitance, and the fiber optic cable will transmit waveforms from the power cable at the reflection points where the power cable and the power cable insulation capacitance decreases or as the power cable insulation becomes porous, then the power cable will emit electrical discharge through the capacitance of the insulation that is picked up by the fiber optic and transmitted to the surface processor for processing. The processor determines whether waveform indicates a reflection point where a pending fault may turn into a ground fault and a ground fault at the fault location. At a reflection point, the current has not changed because there is not a ground fault, however the waveform from the power cable at the reflection exhibits a disruptive or anomalous behavior that is detected at the processor at the surface.

Figure 8:
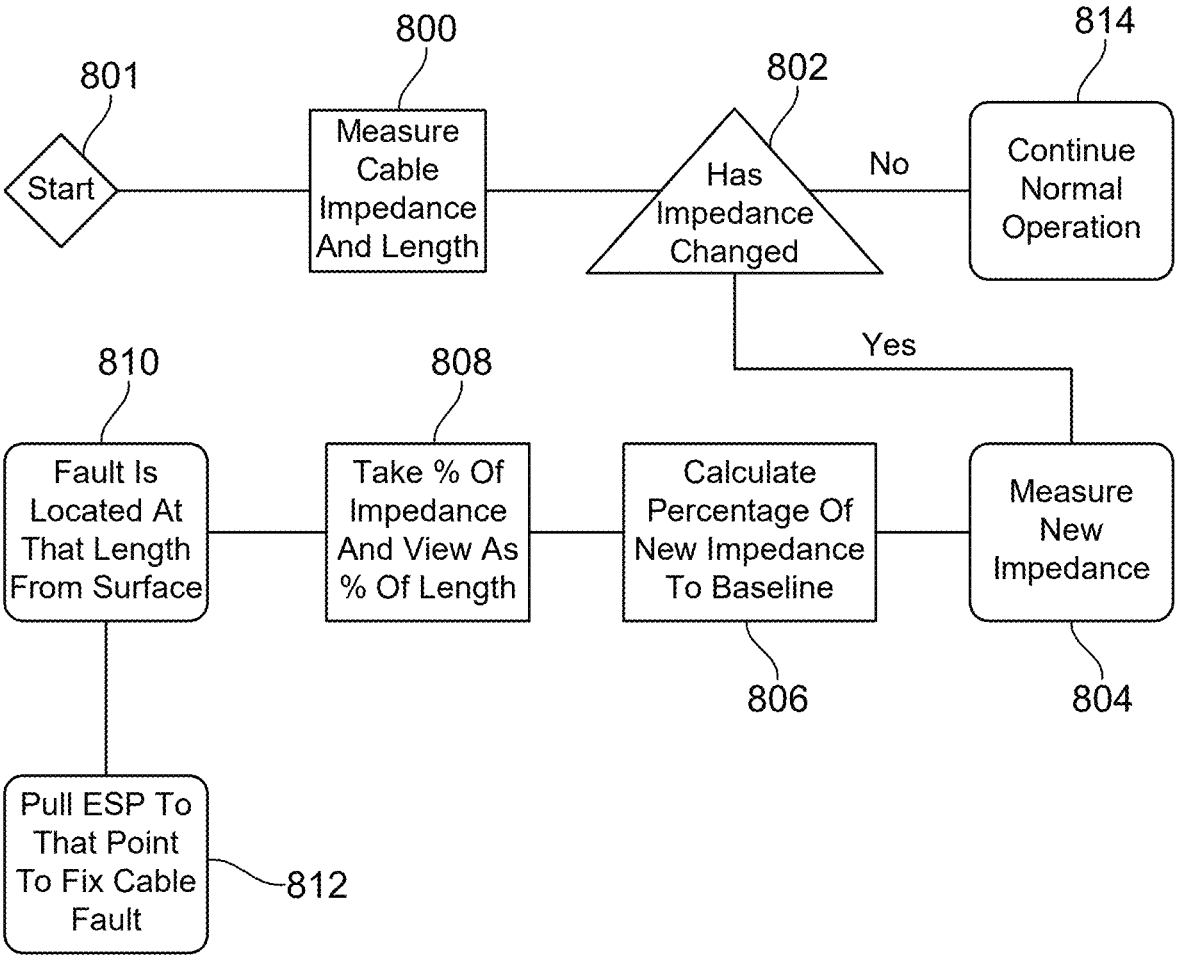
FIG. 8 is a functional block diagram flow chart depicting finding a location for a power cable fault.

Turning now to FIG. 8, a functional block diagram depicts finding a location for a power cable fault. At 800 a processor in the surface equipment including a tangible computer readable medium and a computer program store in the computer readable medium and a sensor measure power cable impedance and length. At 802 the processor determines if the power cable impedance has changed from a prior power cable impedance measurement. If the power cable impedance has not changed from a prior power cable impedance measurement normal operations are continued at 814. When the power cable impedance has changed to a prior baseline cable impedance measurement the new power cable impedance is measured. At 806 the processor calculates a percentage change of the new impedance from the prior baseline power cable impedance. At 808 the processor calculates a percentage change in the power cable impedance from the baseline power cable impedance and determines a percentage of length of the power cable from the surface. At 810 the processor determines that the power cable fault is located at that length from the surface. At 812 an operator pulls the ESP to the fault location to fix the power cable at the fault location, rather than pulling the entire ESP to locate and repair the power cable fault.

Fiber optic cable has been used in the past, however, not as disclosed herein. The present invention provides an enhanced sensor system directly connected to the ESP and a fiber optic cable for locating faults in an ESP power cable. Additional parameters are provided that have not been available in the past that makes available new information that enables a faster response to alleviate problems. The present invention provides an adaptor at the base of the ESP motor the provides potential (voltage) transformers (PTs) and current transformers (CTs) to pull information data from the ESP motor into an integrated package having fiber optic capability and transmit the information to the surface using the fiber optic cable for analysis at the surface. PTs and CTs are not currently available on the motor. Currently PTs and CTs are only available at the surface, that can be miles away from the ESP motor.

In a particular illustrative embodiment of the invention, fiber optic cables are placed in motor windings of the ESP motor. An interface at the surface aggregates the data to place it into a user's SCADA system. This enables additional analysis using enhanced data from the ESP system. The present invention provides a new gauge and fiber optics as inputs to machine learning to predict failures down hole in an ESP system. In a particular illustrative embodiment of the invention, preexisting sensors down hole are enhanced with additional sensors to obtain additional information and faster access to the additional information using fiber optic cable to enable a user to make quicker, earlier, and more intelligent decisions about preventive maintenance and additionally predictive maintenance.

Additional power analysis and waveform distortion analysis are provided. In a particular illustrative embodiment, a fiber optic solution adds sensor inside of the ESP such as temperature embedded in the windings of the ESP motor. Additionally, past systems utilizing communications over the power cable are susceptible to losing data connectivity when a ground fault occurs, that is, when power cable encounters a grounded leg, when a leg of the power cable is shorted to ground. With fiber optics, the present invention enables continuous communication even in the presence of a ground fault on the ESP power cable. This is a huge advantage in the oil production industry and in ESP operations as operators are enabled to avoid intervention pulls to access ESP system faults when an operator loses the ability to collect the data during a ground fault.

The fiber optic cable locates where a transient voltage peak or peaks occur along the power cable to the ESP, so that only that portion of the cable that is experiencing transient voltage peak or peaks need be removed (withdrawn) from the wellbore, down hole installation for inspection and repair to avoid a failure at the location of the transient voltage peak. Transient voltage peaks indicate breakdown of insulation in the power cable supplying power to the ESP. The break down in the insulation can lead to a failure of the cable and interruption of power supplied to the ESP via the cable. The system enables prediction of when and where a cable is going to fail based on the identification and location of the transient voltage peaks. For example, if a transient voltage peak is occurring at a location two joints down in the down hole installation, an operator can retrieve just the first two joints and repair the cable without retrieving the entire ESP installation of multiple joints.

The fiber optic solution is superior to prior methods that used reflectometers to detect failure points rather than degradation associated with transient voltage peaks to predict a failure of the ESP cable. The fiber optic solution provides a continuous monitor. The prior solutions involved periodic testing using a down hole pulse and reflectometers that require complex and time consuming analysis to detect failures in the ESP cable. Moreover, these prior solutions are subject to ground fault interruptions. In a particular illustrative embodiment, a fiber optic cable is attached and laying against the fiber optic cable to the ESP power cable for continuous monitoring of the ESP cable for transient voltage spikes that are used to predict when and where a cable failure will occur.

The present invention enables direct ESP information at and from an ESP down hole and a harmonic picture rather than deriving information from data received at the surface. This direct ESP information enables operators a more informed view and understanding of what is actually happening downhole at the ESP and the cable connected between the surface and the ESP. Typically in the past downhole information was limited to pressure and temperature. The present invention bring power information such as power quality and power harmonics information collected directly at the ESP and ESP cable and quickly and continuously sent to the surface by the fiber optic cable as opposed to relying on surface physics and reflectometer returned pulses based models typically found in preexisting surface based systems.

Prior systems were only capable of analyzing lower harmonic frequencies on the order of a $50^{th}$ harmonic. In the present invention, higher harmonics of $100^{TH}$ harmonic and the $200^{th}$ harmonic and above enable the current invention to determine the health of the ESP system based on the harmonics of the voltage at the ESP downhole and of a sine wave filter (SWF) at the surface that tells an operator what is going on after a step up transformer to the motor. Prior systems were not capable of $100^{th}$ harmonic analysis. Harmonic information tells the health of the sine wave filter. If the harmonics start to increase this indicates that the ESP cable and surface SWF components need to be examined or repaired for possible degradation or failure. The present invention generates power and voltage information to determine the health of the power system generating the sine wave of three phase alternating current power going downhole to the ESP. The power and voltage information also enables determination of a power factor for the power being used to power the ESP.

The power factor indicative of kilowatt usage a production site utilizing an ESP and the present invention is useful to determine how green or a carbon footprint foot an installation is operating, that is, how efficiently the power is being used at the production site utilizing the present invention analyzing the ESP in use. The power factor indicates how much power is being used to produce a given amount of work, that is, the efficiency of the power usage for the ESP. A higher power factor indicates more efficient use of power, that is, less power is used to produce a given amount of work in operating the ESP during oil production. The power factor can be adjusted higher to be more efficient by adding capacitance to the system, as the ESP is primarily an inductive load. The PF is adjusted automatically at the surface by a "computer controlled impedance module" that added capacitance, inductance and resistance at the surface using a filter, a sine wave filter (SWF), a common mode filter (CMF), adding inductance, capacitance and resistance to the system thereby optimizing the set point within the frequency spectrum of the ESP. The voltage distortion is measured and adjusted by the computer controlled impedance module.

The harmonics indicate both PF and the health of an ESP installation. While an operator can operate with suboptimal PF, they cannot operate for long as the poor power quality or low PF will cause failures in the cable supplying power to the ESP and in the ESP itself. The PF helps make more efficient use of power from the electrical network or grid, to make decisions as to where to invest to make best use of the power available to them. Measuring electrical voltages and frequencies directly at the ESP down hole enables an operator to insure that the ESP motor down hole is receiving the proper voltage and voltage frequency so that the motor runs at the proper speed. The speed of the motor and the ESP pump is determined by the voltage and frequency of voltage supplied to the ESP motor. Optimizing the ESP motor down hole is more difficult than optimizing a motor on the surface. The frequency of the voltage and the voltage measured directly downhole at the ESP indicates the rotational speed of the ESP motor and the rotational speed of the ESP that is driven by the ESP motor. A processor optimizes the performance of the motor and the PF. For example, in an example, a surface voltage measured at 60 should cause the ESP motor to run at 3,500 revolutions per minute (RPM). All of a sudden, the measurements indicate the ESP motor is now running at 3,300 RPM which indicates an issue, which could be a pump dragging or something else going on downhole such as a cable problem, causing the operator to get less performance than expected on an ESP pump performance curve (pump RPM v. pump voltage Frequency) than expected.

Three phase voltage and current at the motor are calculated using direct measurements at the ESP which are sent to the surface over the fiber optic cable. The operator can optimize the motor flux density by altering the voltage and frequency to make the ESP motor operate at is most efficient point on the pump operating curve using the data from the voltage and current at the surface. The voltage can be altered by phasing up to a higher voltage at the surface. For example, it you have 450v instead of 480v, the pump performance is off, the voltage can be tapped up to a higher voltage on the transformer at a higher voltage.

ESP motors can be deployed at 2,000 feet or 10,000 feet and voltage losses along the cable can be determined by the ESP sensors, PTs and CTs and transmitted to the surface over the fiber optic cable so that the voltage losses can be compensated for to cause the ESP motor to run at the most efficient point on the ESP pump operating curve. The system impedance, including the power supply cable and the ESP is also controlled by the processor at the surface to add capacitance, inductance, and resistance at the surface to the cable to adjust the frequency of the motor voltage supplied at the ESP so that the ESP motor operates the ESP pump at the so that the pump operates at a substantially optimal point on the pump curve indicating pump speed versus voltage frequency.

Harmonic distortion is determined using sensor measurements. The more distortion in the electrical system, the more potential to cable damage, the more heat created to damage to electrical insulation system and the ESP motor. The system changes operational frequency to reduce harmonic distortion by adjusting the impedance of the power supply to the ESP and the voltage supplied to the ESP. The inductive load of the ESP impacts the harmonic signature and waveform at the load at the ESP motor. If the harmonic distortion goes up at the same operating voltage, this indicates degradation in the surface electronics or downhole so that the problem can be corrected. Thus, the processor automatically adjusts the impedance seen by the power supply so that the actual voltage and frequency at the ESP causes the ESP motor to run at a substantially optimal point on a pump performance curve. The voltage and frequency are altered by the impedance and power loss over the power supply cable so that it differs from the voltage and frequency supplied at surface.

Rotation speed of the shaft is determined from the voltage and frequency sent up hole at the surface over the fiber optic cable. The rotational speed can be compared to the rotational speed of the pump by a proximity sensor on the spline of the motor shaft. Downhole frequency is derived from the voltage frequency which can be validated against and compared to the rotational speed measured by the proximity sensor to validate the operation of the fiber optic data frequency indicating the rotation speed of the motor. The CTs and PTs are attached to the bottom of the motor where the spline of the motor is located. The CTs and PTs are used to determine voltage and frequency at the ESP after it is transmitted over the power supply cable from the surface to the ESP motor.

An adapter module is provided coupling the output of a standard gauge at the bottom of the ESP motor with the fiber optic data in a device and sent to the surface. The termination point of the fiber optics data and sensors in the bottom of the motor and the sensors in the gauge with additional sensors added to the ESP system on the ESP. The CTs and PTs at the vent box is where the down hole cable connects to the surface cable. The interrogator connects to the fiber optic cable to translate the fiber optic cable into a standard Modbus protocol for use by the operator on a SCADA system. The CTs and PTs at the motor are used to directly measure the voltage and frequency directly at the ESP.

Each of the appended claims defines a separate invention which, for infringement purposes, is recognized as including equivalents of the various elements or limitations specified in the claims. Depending on the context, all references below to the "invention" may in some cases refer to certain specific embodiments only. In other cases, it will be recognized that references to the "invention" will refer to the subject matter recited in one or more, but not necessarily all, of the claims. Each of the inventions will now be described in greater detail below, including specific embodiments, versions, and examples, but the inventions are not limited to these specific embodiments, versions, or examples, which are included to enable a person having ordinary skill in the art to make and use the inventions when the information in this patent is combined with available information and technology. Various terms as used herein are defined below, and the definitions should be adopted when construing the claims that include those terms, except to the extent a different meaning is given within the specification or in express representations to the Patent and Trademark Office (PTO). To the extent a term used in a claim is not defined below or in representations to the PTO, it should be given the broadest definition persons having skill in the art have given that term as reflected in at least one printed publication, dictionary, or issued patent.

The invention claimed is:

1. An electrical submersible pump monitoring and diagnostic system, the system comprising:

a wellbore drilled in a surface of Earth;

a surface monitoring system that monitors the electrical submersible pump;

an electrical submersible pump deployed down hole in the wellbore and exchanging data with the surface monitoring system;

a motor on the electrical submersible pump;

a power cable having an insulation, wherein the power cable is attached to the electrical submersible pump that supplies power to the electrical submersible pump;

a fiber optic cable attached to the electrical submersible pump and the surface monitoring system;

a plurality of sensors that receive data from the electrical submersible pump, wherein the fiber optic cable is attached to the plurality of sensors;

an adapter that connects between the electrical submersible pump motor and at least one of the plurality of sensors, wherein the adapter accepts connections from the electrical submersible pump motor;

wherein the plurality of sensors provide input data that comprises voltage transformers that transmit data extracted electrical information from the electrical submersible pump motor, wherein the electrical information further comprises electrical frequency spectrum information from the electrical submersible pump motor; and a processor in the surface monitoring system attached to the fiber optic cable that receives data from the sensor, wherein the processor determines when electrical submersible pump performance is degrading.

2. The system of claim 1, wherein the plurality of sensors further comprise current transformers and voltage transformers configured to monitor the electrical submersible pump.

3. The system of claim 2, further comprising:

an aggregation configured to receive data from the plurality of sensors, wherein the fiber optic cable sends data from the plurality of sensors to the surface monitoring system.

4. The system of claim 3, wherein the sensors further comprise:

piezoresistive, wireless and quarts sensing devices located at the electrical submersible pump.

5. The system of claim 1, wherein the adapter accepts input data from at least one of a temperature sensor, current transformer sensor, voltage transformer sensor, proximity sensor, hydraulic sensor and an external source and conveys the input data to the surface monitoring system for processing.

6. The system of claim 5, wherein the adapter consolidates the input data and transmits the input data to the surface monitoring system.

7. The system of claim 5, wherein the adapter transmits the input data via a superimposed signal over the power cable.

8. The system of claim 5, wherein the adapter transmits the input data over the fiber optic cable.

9. The system of claim 1, wherein electrical frequency spectrum information further comprises electrical frequency spectral data up to a 100th harmonic, wherein the processor predicts a failure in the electrical submersible pump based on the electrical frequency spectrum information.

10. The system of claim 1, wherein electrical frequency spectrum information further comprises electrical frequency spectral data up to a 200th harmonic by applying a Fast Fourier transform to the electrical frequency spectrum information, wherein the processor predicts a failure in the electrical submersible pump based on the electrical frequency spectrum information.

11. The system of claim 1, wherein the sensors directly monitor a speed of rotation of the electrical submersible pump motor using a proximity sensor located at a bottom of a shaft of an electrical submersible pump motor.

12. An electrical submersible pump monitoring and diagnostic system, the system comprising:

a wellbore drilled in a surface of Earth;

a surface monitoring system that monitors the electrical submersible pump;

an electrical submersible pump deployed down hole in the wellbore and exchanging data with the surface monitoring system;

a motor on the electrical submersible pump;

a surface monitoring system that monitors the electrical submersible pump;

a power cable having an insulation, wherein the power cable is attached to the electrical submersible pump that supplies power to the electrical submersible pump;

a fiber optic cable attached to the electrical submersible pump and the surface monitoring system;

a plurality of sensors that receive data from the electrical submersible pump, wherein the fiber optic cable is attached to the plurality of sensors;

an adapter that connects between the electrical submersible pump motor and at least one of the plurality of sensors, wherein the adapter accepts connections from the electrical submersible pump motor;

wherein the sensors further comprise data that combines a temperature profile along motor windings and at a head of the electrical submersible pump motor by incorporating a fiber optic cable within the motor windings during manufacture.

13. The system of claim 12, wherein the system is configured using both fiber optic cable and a power cable between the electrical submersible pump and the surface monitoring system to provide full communication, even when the power cable encounters a grounded leg.

14. The system of claim 12, wherein the system is configured to provide outputs from the electrical submersible pump that are used by the surface monitoring system to prevent premature failure of the electrical submersible pump.

15. The system of claim 12, wherein the system is configured to provide outputs to enable the system to be operated more efficiently electrically by maximizing real power, the system further comprising:

a filter to adjust a power factor of power supplied from the surface to the electrical submersible pump, wherein the power factor is adjusted at the surface using the filter, a common mode filter, adding inductance, optimizing a set point within a frequency spectrum of the electrical submersible pump.

16. The system of claim 12, wherein the processor detects and locates faults in the power cable using fiber optic cable, wherein the fiber optic cable monitors transient gradients along the power cable, wherein the processor determines integrity of the insulation of the power cable along a length of the power cable.

17. The system of claim 16, wherein the processor determines a location of the fault along the power cable so that only the length of the power cable from the surface to the location of the fault, need be withdrawn from the wellbore for repair, wherein the processor determine a percentage of impedance change on the power cable and determines the location of the fault at a percentage of the length of the power cable corresponding to the percentage of change in the impedance of the power cable.

18. A method for monitoring a downhole electrical submersible pump, the method comprising:

monitoring an electrical submersible pump deployed downhole at a surface monitoring system over a fiber optic cable;

monitoring a plurality of sensors that receive data from the electrical submersible pump, wherein the fiber optic cable is attached to the plurality of sensors through an adapter that connects between the electrical submersible pump motor and at least one of the plurality of sensors, wherein the adapter accepts connections from the electrical submersible pump motor; wherein the plurality of sensors provide input data that comprises voltage transformers that transmit data extracted electrical information from the electrical submersible pump motor, wherein the electrical information further comprises electrical frequency spectrum information from the electrical submersible pump motor; and determining when a performance of an electrical submersible pump is degrading on a processor in the surface monitoring system attached to the fiber optic cable that receives data from the sensor.

* * * * *